US012344422B2

(12) United States Patent
Biondi et al.

(10) Patent No.: US 12,344,422 B2
(45) Date of Patent: Jul. 1, 2025

(54) PACKAGING APPARATUS AND PROCESS

(71) Applicant: G.D S.P.A., Bologna (IT)

(72) Inventors: Andrea Biondi, Bologna (IT); Luca Cavazza, Bologna (IT); Umberto Zanetti, Bologna (IT); Enrico Campagnoli, Bologna (IT); Antonio Gigante, Bologna (IT); Giacomo Noferini, Bologna (IT); Cristian Dakessian, Bologna (IT)

(73) Assignee: G.D S.P.A., Bologna (IT)

( * ) Notice: Subject to any disclaimer, the term of this patent is extended or adjusted under 35 U.S.C. 154(b) by 0 days.

(21) Appl. No.: 18/006,719

(22) PCT Filed: Jul. 26, 2021

(86) PCT No.: PCT/IB2021/056721

§ 371 (c)(1),
(2) Date: Jan. 24, 2023

(87) PCT Pub. No.: WO2022/029549

PCT Pub. Date: Feb. 10, 2022

(65) Prior Publication Data

US 2023/0271733 A1 Aug. 31, 2023

(30) Foreign Application Priority Data

Aug. 7, 2020 (IT) ..... 102020000019612

(51) Int. Cl.
*B65B 7/28* (2006.01)
*B65B 7/01* (2006.01)
(Continued)

(52) U.S. Cl.
CPC ..... *B65B 7/01* (2013.01); *B65B 7/162* (2013.01); *B65B 7/2807* (2013.01); *B65B 29/022* (2017.08)

(58) Field of Classification Search
CPC ..... B65B 7/01; B65B 7/162; B65B 7/2807; B65B 29/022; B67B 3/04; B31D 1/0018
(Continued)

(56) References Cited

U.S. PATENT DOCUMENTS 2,599,820 A * 6/1952 Ford ..... B67B 3/02 493/103
3,509,682 A * 5/1970 Logemann ..... B65B 7/01 53/298
(Continued)

FOREIGN PATENT DOCUMENTS

DE 1274491 B 8/1968
DE 2054228 A1 3/1972
(Continued)

OTHER PUBLICATIONS

International Search Report and Written Opinion for International PCT Application No. PCT/IB2021/056721 filed on Jul. 26, 2021, on behalf of G.D S.P.A., Mailed on Nov. 17, 2021, 11 Pages.

*Primary Examiner* — Stephen F. Gerrity
(74) *Attorney, Agent, or Firm* — Steinfl + Bruno LLP

(57) ABSTRACT

In an apparatus and a packaging process of capsules with an opening closed by a laminar lid obtained by cutting a strip, the ability of transporting the laminar lids in several lines is introduced, reducing the overall dimensions. The apparatus includes: a cutting device with a mechanism defining a portion of the strip where the strip is tensioned in a respective cutting plane, and one or more punches obtaining the laminar lids from the strip; a carousel-like transfer device, having transfer members movable along a closed path, with gripping heads configured to receive respective laminar lids from the cutting device. The cutting plane is in a vertical position, and the mutual position of the cutting device and the transfer device defines a gripping spot of the closed path,
(Continued)

the laminar lids being retained in the transfer members on a respective plane in a vertical position.

13 Claims, 6 Drawing Sheets

(51) Int. Cl.
*B65B 7/16* (2006.01)
*B65B 29/02* (2006.01)

(58) Field of Classification Search
USPC ..... 53/485, 487, 287, 296, 297, 298
See application file for complete search history.

(56) References Cited

U.S. PATENT DOCUMENTS 3,971,188 A * 7/1976 Cawrse ..... B65B 7/2807 53/478
4,065,909 A * 1/1978 Mueller ..... B65B 7/2807 53/129.1
4,238,267 A * 12/1980 Konstantin ..... B29C 66/542 156/499
4,250,686 A * 2/1981 Fujio ..... B21D 51/46 53/296
6,684,604 B2 * 2/2004 Luc et al. ..... B65B 7/01 53/244
2006/0213151 A1 * 9/2006 Heil et al. ..... B65B 7/2807 53/487

FOREIGN PATENT DOCUMENTS

DE 10201915 A1 * 8/2003 ..... B31D 1/0018
EP 0960024 A1 12/1999
EP 1564143 A1 8/2005
JP H01240403 A * 9/1989
WO 2015/121838 A2 8/2015

* cited by examiner

PACKAGING APPARATUS AND PROCESS

CROSS REFERENCE TO RELATED APPLICATIONS

The present application is the US National Stage of International Patent Application No. PCT/IB2021/056721, filed on Jul. 26, 2021, which in turn, claims priority to Italian Application No. IT 102020000019612, filed on Aug. 7, 2020.

The present invention relates to an apparatus and a packaging process, for closing capsules by applying a laminar lid obtained by a process of cutting a strip stretched on a plane.

The present invention finds a preferred, though not exclusive, application in the field of packaging of capsules, for example infusion type capsules for infusion type products, in particular beverages obtained by an infusion process and with the addition of an edible liquid such as water or milk, to obtain an infusion, for example coffee, a field to which reference may be made hereafter without loss in generality.

In particular, in the relevant technical field, packaging apparatuses are known which include obtaining, by means of a cutting operation, a flow of laminar lids which are to be applied to seal a container which may have the shape of a cup-like element, with an opening to which the lid is secured.

Therefore, the need to individually form and apply a quantity of laminar lids implies the need to transfer them from a cutting station, where the lids are obtained from a strip, to a sealing station, where the lids are placed on the opening of a respective container, which in turn moves through a packaging process.

In this description and in the accompanying claims as well, certain terms and expressions are deemed to have, unless otherwise expressly indicated, the meaning expressed in the following definitions.

Herein and in the following, a laminar lid is defined as an element formed from a single piece, usually with a disc shape, which must be individually processed at high speed, with the final aim of laminating it to a corresponding target container.

In particular, it is envisaged that these laminar lids, downstream of a cutting station comprising a cutting device, are subsequently fed into a flow of laminar lids, in which they can be arranged, if necessary, in several lines with a predetermined spacing between them, which allows the intervention of tools without them interfering with laminar lids that are not their responsibility.

Once obtained, these laminar lids must each be placed on a respective capsule that receives it, in order for the necessary capsule closure operations to be carried out, which may include sucking the atmosphere contained therein and a subsequent or simultaneous sealing.

It is understood that the laminar lids are therefore applied once the capsules have been supplied with their contents, which in the case of infusion type capsules includes a filter and an infusion preparation, e.g. powder.

In this process, both the capsules and the laminar lids are continuously transported as they move with a predetermined speed, possibly variable, i.e. subject to accelerations and decelerations, but never nihil. Continuous feeding and transport are therefore different from step feeding and transport, in which the corresponding discrete elements and/or receiving elements move in jerks.

The term "capsule" means an essentially cup-shaped container, i.e., a hollow element of round or cylindrical shape intended to form a capsule with the function of a receptacle, a wrapping, a covering, a protection, a cover or a closure for a product contained within it, thus possessing a predetermined shape, in which a head and a bottom are identified, which provides for it to be arranged in an upright vertical arrangement with the head pointing upwards, which in turn has an opening that may be sealed by a lid.

In turn, the capsules will have a substantially truncated conical or truncated pyramidal shape, or equivalent shapes.

"Sealing" means the final airtight application of the laminar lid to the opening of the container constituting the capsule. It is done by welding or gluing, or by an operation involving both. Sealing allows the contents of the capsule, and any inert protective atmosphere placed within it, to be permanently separated from the sterile atmosphere, at least until the lid itself is removed or punctured.

Feeding or transferring "in a line" means that the laminar lids, as discrete elements, are supplied in a sequence of substantially aligned lids, resulting from a cutting operation of the working process.

It is understood that in the line, each discrete element is spaced from the elements preceding and following it with a constant spacing, resulting from the extraction and/or processing step.

"Cutting device" means a device that obtains laminar lids by means of a cutting operation, carried out on a laminar element such as a sheet or a strip. In particular, a solution using a strip of material for laminar lids, which is supplied wound on a reel and is unwound and slid under tension, is preferred for the practicality thereof.

The term "punch" refers to a tool that is pressed onto a flat substrate, such as said strip, to obtain, by a single cutting action, a discrete element such as said a laminar lid. The punch is moved by a reciprocating motion and has a head comprising a knife, formed by a continuous blade that follows a profile equal to that of the edge of the element being cut.

"Cutting plane" means a plane on which the flat element from which the lids are obtained by means of said cutting lies; it is obtained by subjecting the flat element from which the lids are obtained to a tension, and by using contrast elements. Preferably, the flat element from which the laminar lids are obtained by means of a cutting operation is a strip, supplied in reels, which is tensioned between two tensioning rollers so as to form said cutting plane. This strip is made of a flexible material, the shape of which adapts to the stresses imposed on it.

The terms "horizontal" and "vertical" refer to the positions of various elements with respect to the ground, which defines a vertical plane and on which the frames of the apparatuses forming a capsule production apparatus rest.

A "carousel-like transfer device" is understood as any system intended for the transport of discrete elements retained by respective moving transfer members, moving along a closed transport path, that is, a transport path which develops along a closed line on a substantially horizontal plane; whereas the "carousel" structure is understood as a transport device which operates on said closed transport path, making the moving members therein provided, carry out a so called revolution which, for this reason, should not be confused with the alternated roundtrip motion that is typical for a belt conveyor.

"Cam" means a physical or virtual member that is provided to drive the timing mechanism. The concept of a cam can be interpreted in the mechanical sphere as an element that determines a cam profile on which a plurality of articulated cam followers with respective moving members slide. However, the same concept can be realised by a set of electric and electronic motors and devices, which are driven according to a virtual cam profile of a so-called electronic cam.

"Transfer segment" means a segment of said transport path along which said transfer device transfers, i.e. receives or releases, discrete elements such as laminar lids.

"Gripping head" means a member of the moving transfer member on which the laminar lid is placed; the gripping head is equipped with a system that actively or passively retains the laminar lid in a predetermined position, such as a suction system or a suction cup.

The Applicant observed that, in packaging processes, the speed at which the lids are fed and the capsules are sealed is crucial to the overall economics of the process, as high production volumes can be achieved with fewer packaging apparatuses.

Furthermore, the Applicant observed that, in addition to the need to proceed as quickly as possible, another important and unavoidable requirement is the reduction of the overall spaces, which allows the design of compact packaging apparatuses and therefore easier management.

This need is particularly acute at high speeds, when precise and correct positioning of the different transfer devices is critical to the economy of the production process.

Furthermore, this need is reinforced when, in a packaging machine, an increase in the process speed is required and which must be managed without any inconvenience or error.

Furthermore, the apparatus must also be able to manage lids and capsules of different format, in which they adapt and are coupled to each other in the sealing operations, and this requires that the transfer of the laminar lids can adapt to different formats.

The Applicant also verified that the continuous feeding of laminar lids, and thus also the performance of the cutting operations in a packaging apparatus, allows the productivity rates required for this type of apparatus to be achieved, leading to a reduction in feeding and passing times.

The Applicant found that, in general, the transport of freshly cut laminar lids in a vertical position, possibly on several superimposed lines, represents a promising starting point for the realisation of an apparatus and a process for packaging infusion type capsules.

The Applicant, however, understood that this requirement is manifested in both continuous and step transfer, and especially in high-speed transfer this problem requires the adoption of appropriate measures to achieve the required flexibility.

The Applicant therefore perceived that the adoption of a cutting plane arranged vertically, with respect to the plane on which the transport path of the device that removes the cut lids substantially lies, can allow the rapid transfer of the lids, even on superimposed lines, with a strong positive effect on the overall process speed.

Finally, the Applicant found that synchronising the cutting of the laminar lids on a vertical plane, and then removing and transferring them by retaining them on a respective plane in a vertical position, optimises both the cutting and transfer steps, allowing for a reduction in the overall spaces and all the flexibility required.

In particular, in a first aspect thereof, the invention relates to an apparatus for packaging capsules, wherein the capsules comprise a container with an opening apt to be closed by a laminar lid applied thereto.

The aforesaid laminar lid is formed by cutting a strip.

Preferably, the packaging apparatus according to the present aspect comprises a cutting device.

Preferably, the cutting device comprises a tensioning and transport mechanism for said strip, so that a segment thereof is tensioned over a respective cutting plane.

Preferably, the cutting device also comprises one or more punches that obtain said laminar lids from said strip.

Preferably, the packaging apparatus according to the present aspect comprises a carousel-like transfer device having a plurality of moving transfer members.

Preferably, each moving transfer member has one or more gripping heads, apt to receive a respective laminar lid from the cutting device.

Preferably, the moving transfer members move along a closed path.

Preferably, in the packaging apparatus according to the present aspect, said cutting plane is arranged in a vertical position.

Furthermore, the mutual position of the cutting device and the transfer device defines a gripping spot of said closed path where the laminar lids are retained in said moving transfer members on a respective plane in a vertical position.

Thanks to these features, it is possible to reduce the overall dimensions of the cutting device, and the packaging mechanism as a whole.

Furthermore, thanks to these features, the laminar lids can be transported in one or even several lines, creating a continuous flow of laminar lids for a subsequent sealing step.

This allows them to vary their speed of circulation, without causing any inconvenience in the cutting and transfer process.

In a second aspect thereof, the invention relates to a process for packaging capsules comprising a container with an opening apt to be closed by a laminar lid applied thereto.

Preferably, the packaging process includes a cutting step in which a strip is transported in a tensioned state on a cutting plane arranged in a vertical position.

In this way, one or more punches remove corresponding laminar lids from said strip.

Preferably, the packaging process includes a step of gripping the laminar lids, which, once cut by these punches, are grasped at a gripping spot by respective gripping heads.

Preferably, said gripping heads move along a closed path.

Preferably, at said gripping spot, the laminar lids are retained on a respective plane in a vertical position.

In other words, the arrangement of the cutting plane and the laminar lids in their transfer segment allows both a reduction in the overall dimensions and an increased flexibility in terms of the speed of the flow of the laminar lids, which can be transported in one or more lines.

In a third aspect thereof, the invention relates to an apparatus for producing infusion type capsules, comprising a packaging apparatus according to the aforesaid first aspect.

Thanks to its characteristics, the production apparatus can be built in a more compact form.

In at least one of the aforesaid aspects, the present invention may further comprise at least one of the following preferred features.

Preferably, the transport path of the moving transfer members comprises a transfer segment extending from said removal spot to a subsequent release spot of the laminar lids. This transfer segment is thus entirely formed on the carousel-like transfer device, making it compact.

Preferably, in the aforesaid packaging apparatus, each moving member moves between a transport configuration and a gripping configuration.

Preferably, in the gripping configuration said at least one gripping head is moved towards to the strip at said gripping spot.

Preferably, the transport configuration is realised in said transfer segment of the closed path.

In this way, the gripping head can be moved towards the strip while it is cutting, and can receive the lid directly without any intermediate step that would slow down the transfer.

Preferably, the laminar lids are retained by the respective gripping heads in a vertical position throughout the transfer segment, so as to reduce the transport footprint, with the possibility of multiplying the lines of which the flow of laminar lids is composed by the number of gripping heads of each moving transfer member, i.e. by the number of punches of the cutting device.

Preferably, each moving transfer member comprises two or more gripping heads, which are arranged in a vertical line, i.e. one on top of the other in the same moving transfer member.

Preferably, the positions of the two or more gripping heads in said gripping configuration correspond, in the cutting device, to as many punches arranged in turn in a column.

Thanks to this configuration, it is possible to transport the laminar lids in two or more lines, increasing the flow of lids at the same speed of rotation of the transfer device.

Preferably, at said cutting plane, the strip is arranged so as to be tilted with respect to the plane on which said closed path lies, even more preferably by about 45°.

In this way, the lids are cut, in said strip, in several lines, in which the lids are staggered to each other.

Thanks to this configuration, the strip from which the laminar lids are cut is exploited in the best possible way, removing the maximum possible amount of material therefrom.

Preferably, each moving member comprises a rotary actuator which is arranged to rotate it about an axis which is perpendicular to the plane on which said closed path lies, from said transport configuration to said gripping configuration and vice versa.

In this way, the structure of the transfer device and the moving members is considerably simplified, considering that this movement can be programmed with a simple mechanical or possibly even electronic cam.

Preferably, the aforesaid rotary actuator comprises a cam, simplifying the movement of the moving members.

Preferably, each gripping head is a suction head, simplifying the gripping mechanism of laminar lids.

Preferably, the transfer device comprises a cylindrical drum rotating about a vertical axis, and the moving transfer members are arranged on a closed circular path formed on the periphery of the rotary drum.

In this way, the structure of the transfer device is greatly simplified in realising this closed path.

Preferably, in the packaging process, said laminar lids are transported by said respective gripping heads in a flow formed by two superimposed lines of laminar lids.

This makes it possible to achieve a higher flow rate of laminar lids with the same cutting frequency, thereby increasing the overall rate of capsule flow in the production apparatus.

The present invention will hereinafter be described according to a preferred embodiment thereof, which is provided for illustrative and non-limiting purposes with reference to the accompanying drawings in which.

Figure 1:
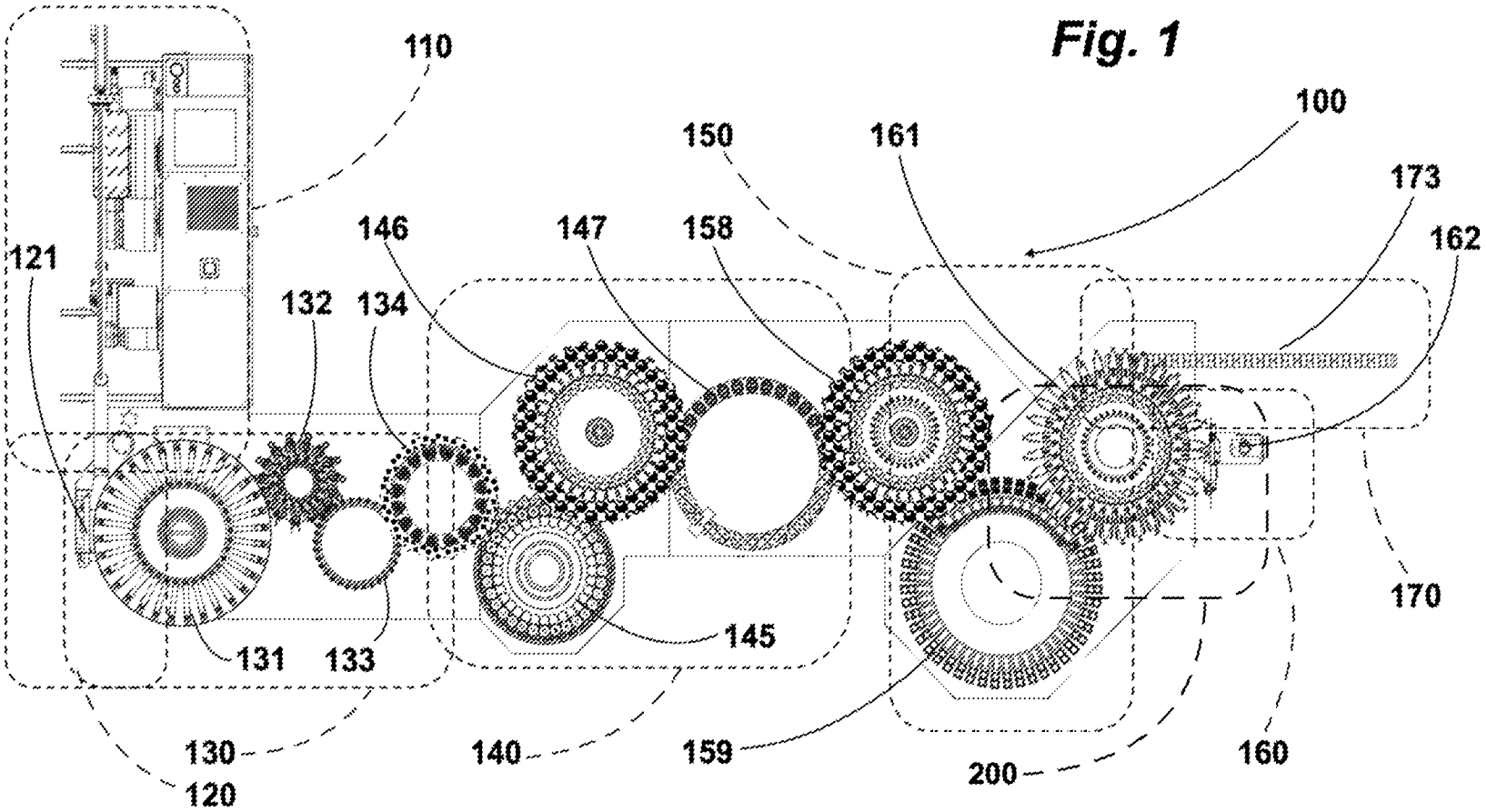
FIG. 1 shows a plan view of an embodiment of a production apparatus for infusion type capsules comprising a packaging apparatus made according to the present invention.

With reference to the accompanying FIG. 1, an apparatus for producing capsules for infusion type beverages, such as coffee is referred by 100, mentioned in the following for short as infusion type capsules.

These infusion type capsules, indicated by 1, are formed by a substantially rigid cup-shaped container, inside which a filter is arranged.

The container comprises an opening which is apt to be closed by a laminar lid 2 of a material suitable for sealing the capsule.

The lid, which is usually disc-shaped to couple the circular edge of said opening, is applied thereto.

The laminar lid is obtained, by means of a cutting operation, from a flat strip 3, supplied wound on reels.

During the subsequent packaging steps, a preparation based on coffee powder is added to the infusion type capsules 1, and then the capsules 1 are sealed with the application of a lid 2 and sent to a subsequent apparatus where they are boxed for distribution and sale.

In general, the cup-shaped containers of the capsules 1 are supplied a feeding station 110, from which they proceed in a line with a continuous motion after being extracted from a set of cup-shaped containers provided by a supplier.

The packaging apparatus 100 comprises a release station 120 of discrete elements, which in the present example are constituted by flat discs of a material suitable for forming a filter for infusion type products, in particular beverages.

Thus, the release station 120 comprises a release device 121 which in the present example is a device for cutting said discs from a continuous strip of filter material.

The packaging apparatus therefore comprises a filter forming station, indicated by 130, which comprises a device 131 for producing infusion type capsules 1 of the carousel type, which is part of a more complex station, in which the discrete elements undergo a filter forming process, which is then inserted into the target cup-shaped container.

At the end of the step of inserting the filter into the respective cup-shaped container, the filter is fixed, for example by welding, to the internal walls of the cup-shaped container, thus forming the infusion type capsule.

In this connection, the transport device 131 transfers the cup-shaped containers with filters to a first transfer wheel 132, and from this they pass to a filter fixing wheel 133, then to pass to a second transfer wheel 134 which transfers the cup-shaped containers to a filling station 140, where they are filled with a predetermined dose of coffee powder.

In this regard, the filling station comprises a carousel-like filling device 145 from which the cup-shaped containers are transferred, by means of a third transfer wheel 146, to a carousel-like weighing device 147, performing a check on the amount of powder supplied to each container.

Upon leaving the weighing device 147, the containers are transferred by a fourth transfer wheel 158 to a sealing station 150. The apparatus 100 thus comprises a cutting station 160 for lids that are formed from a continuous strip by a cutting device 162.

The cutting device 162 is part of a packaging apparatus referred to as a whole by 200; it further comprises a carousel-like transfer device 161 which carries out the transfer of the laminar lids 2 to a sealing device 159, also structured as a carousel, which in turn receives the infusion type capsules to be sealed by said fourth wheel 158.

The sealing device 159 extracts the gases from the capsule 1 and seals it by applying to the upper opening thereof the disc-shaped lid 2 formed from said continuous strip 3.

Once sealed, the capsules 1 are sent to an outlet station 170, through a transport wheel which is provided in said transfer device (FIG. 2), up to a linear transport device 173.

Figure 2:
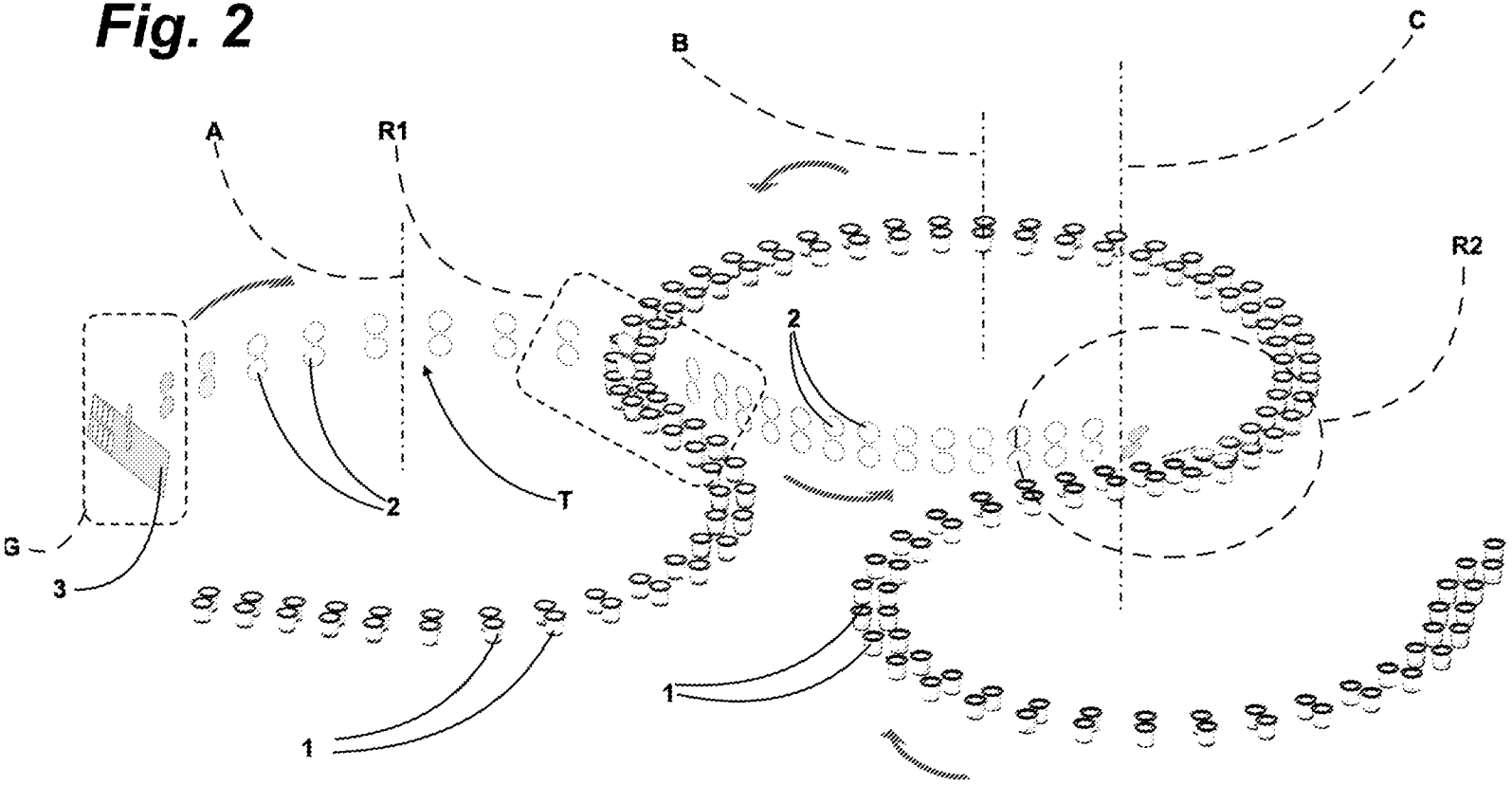
FIG. 2 shows a schematic perspective view illustrating the movement of the lids and capsules in the production apparatus of FIG. 1.
Figure 3:
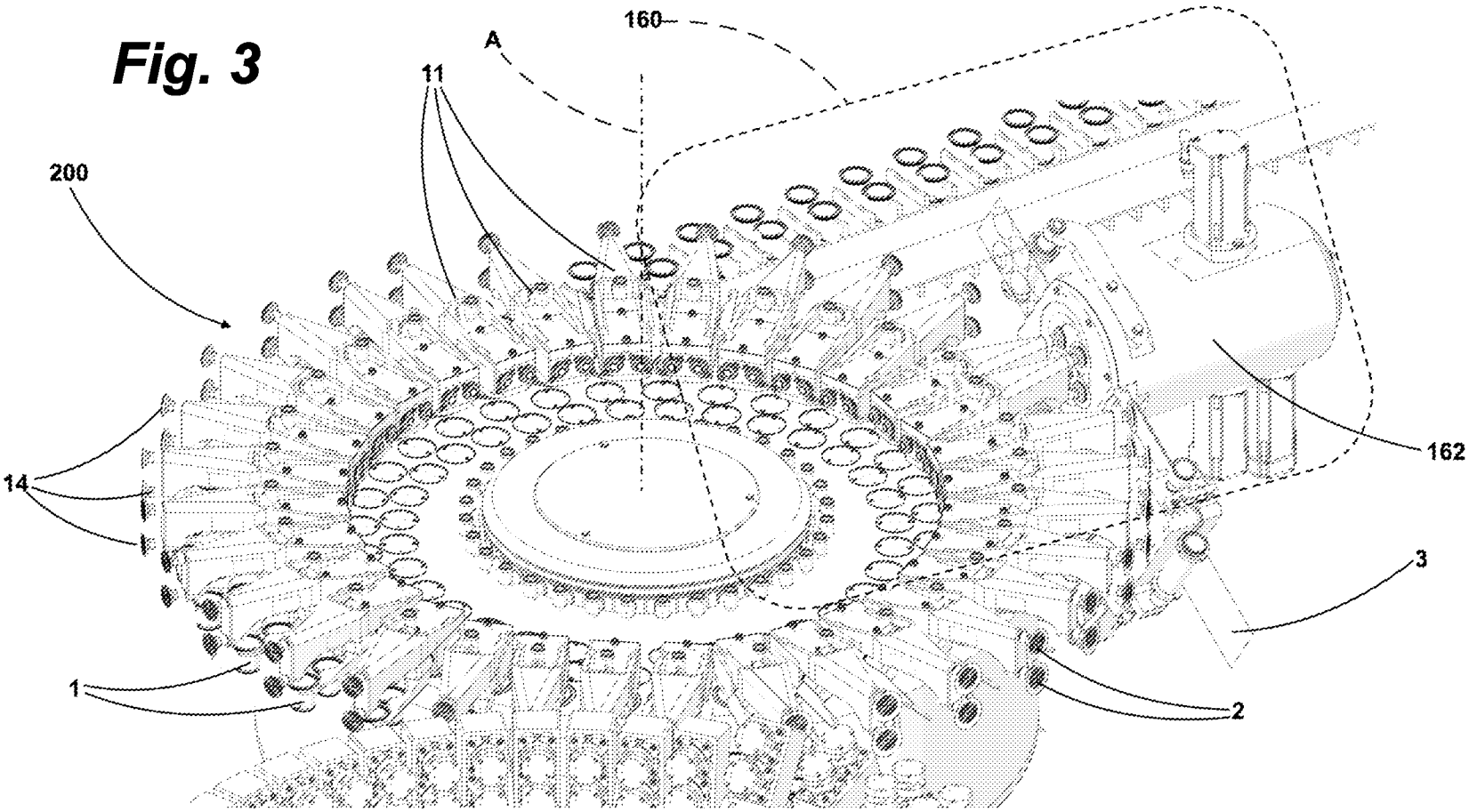
FIG. 3 shows a perspective view of the packaging apparatus of an embodiment according to the present invention.

With reference to FIG. 2 onwards, the packaging apparatus 200 comprises a carousel-like transfer device 161, which in turn comprises a cylindrical-shaped rotary drum 10 rotating about a vertical axis A, i.e. perpendicular to the ground, and having a circular periphery.

The transfer device 161 has a plurality of moving transfer members 11 which are arranged equally distanced on the upper surface of the rotary drum 10, at its circular periphery, so that they can rotate with the drum 10, defining a closed transport path that lies in a horizontal plane, i.e. perpendicular to the axis of rotation of the drum 10, and substantially circular.

Figure 4:
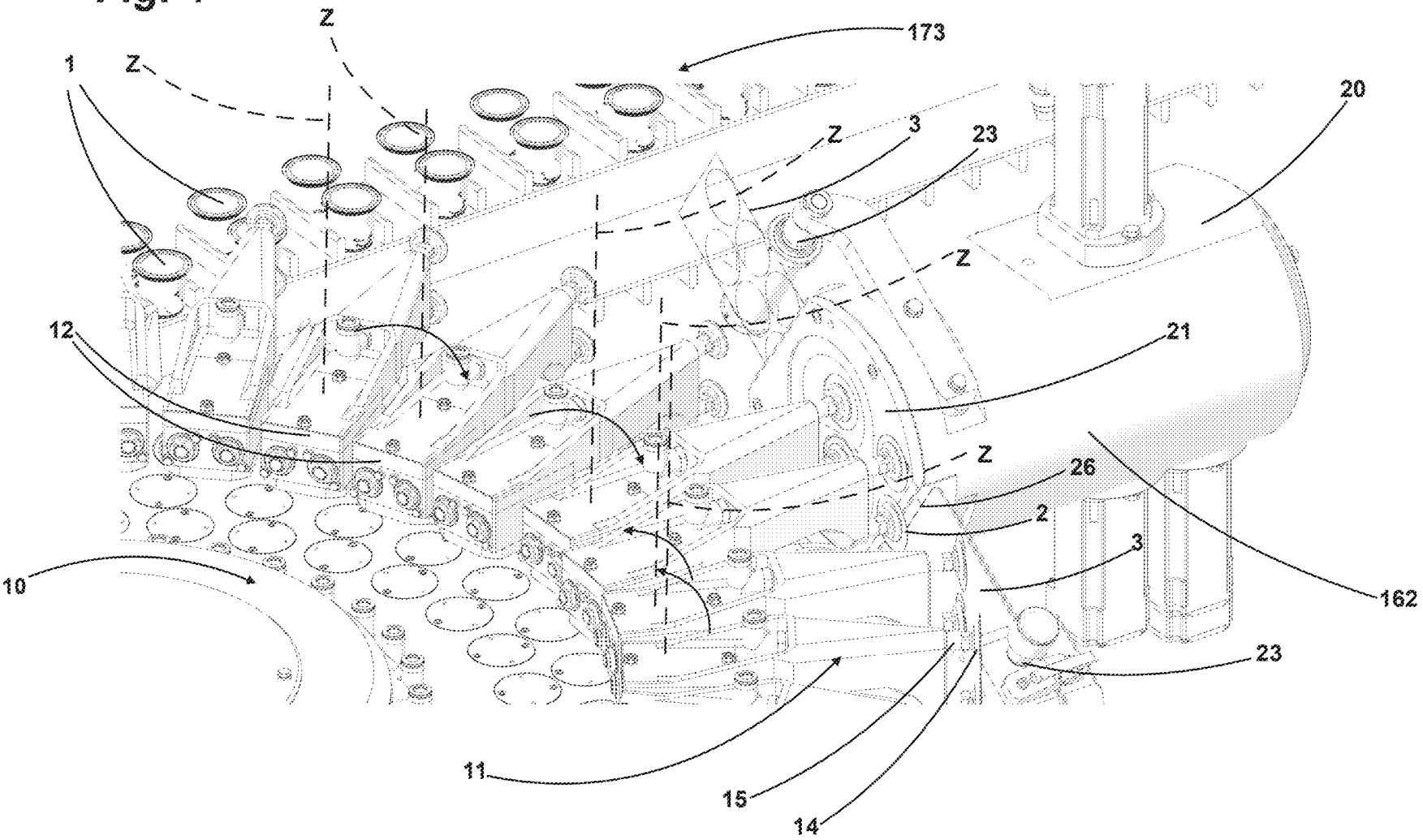
FIG. 4 shows an enlarged perspective view of a detail of the packaging apparatus in FIG. 3.
Figure 5:
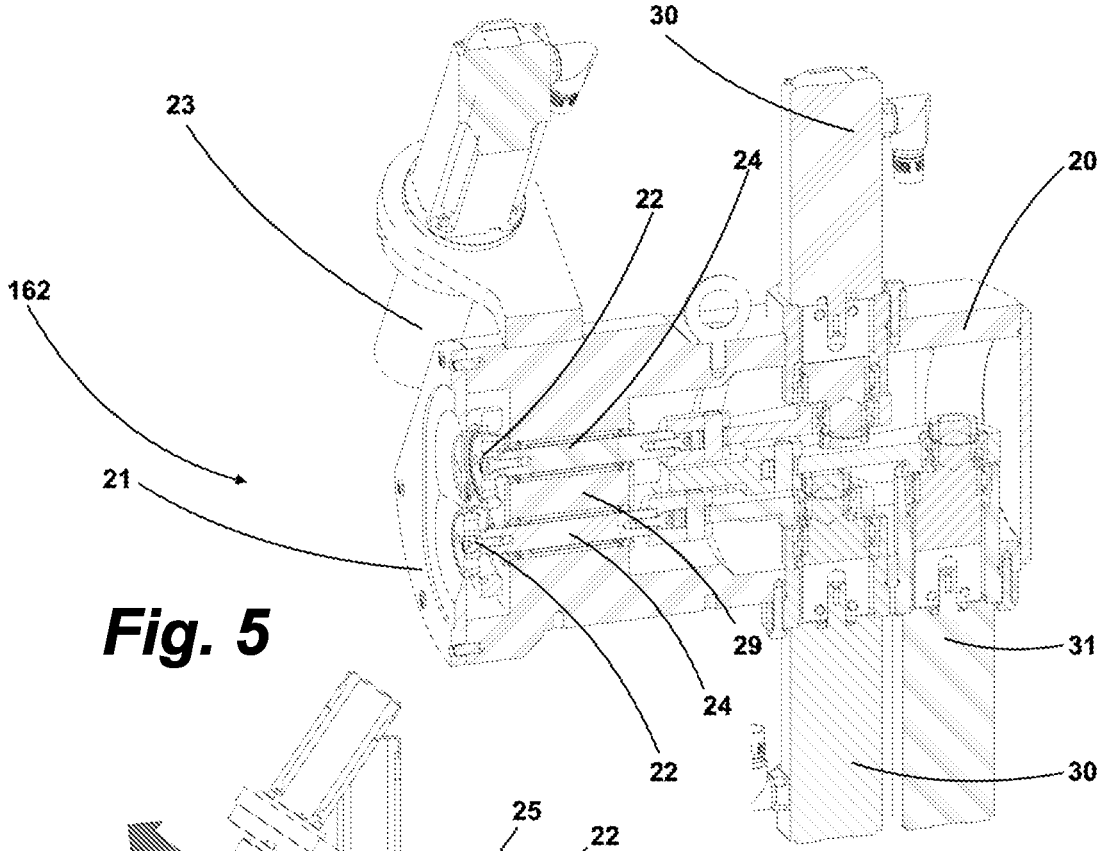
FIG. 5 shows a perspective view in longitudinal section of a cutting device in the packaging apparatus of FIG. 3.
Figure 6:
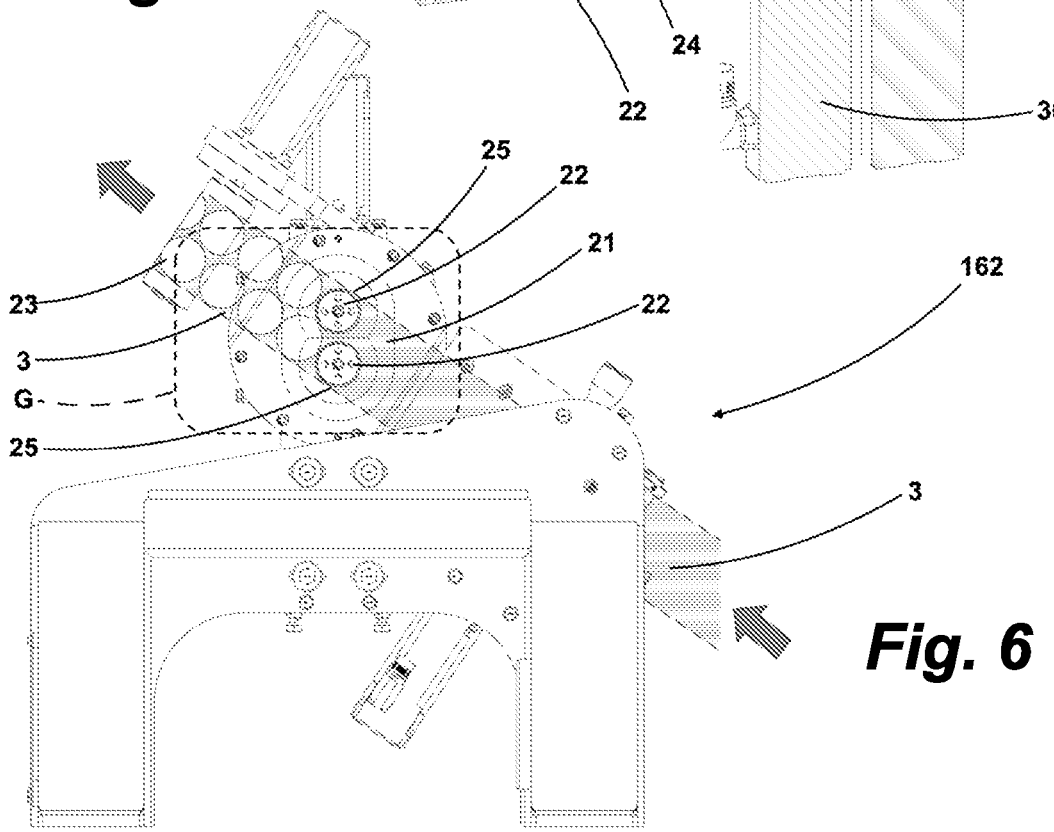
FIG. 6 shows a frontal elevation view of the cutting device in FIG. 5.

Each moving transfer member 11 comprises a body 12 resting on said circular periphery, which is mounted on a rotating shaft about a vertical axis Z, so that each member 11 can swing (FIG. 4) about this axis Z with a flag-like motion. The reason for this movement will be explained in detail below.

The oscillation movement is determined by a rotary actuator, which rotatably drives each moving member at a gripping spot G of the transport path of the moving transfer members 11, which corresponds to the position of the cutting device 162 of the cutting station 160.

Each moving member 11 comprises, in the present example, a pair of gripping heads 14 which are fixed to a respective stem 15 protruding from the moving member externally to said periphery of the rotary drum 10.

It is understood that there could also be a single gripping head for each moving member, or more than one, and in particular two, or more than two.

In this preferred embodiment, there are two gripping heads 14 which are arranged in a vertical columnar fashion, i.e. one on top of the other, in the moving transfer member 11, and move together when the moving transfer member 11 is rotated.

A version may also be provided in which the stem 15 is alternatively moved, by the action of a linear actuator, so that the gripping heads protrude at least at said gripping spot G, which corresponds to said cutting device 162.

The gripping heads 15 are, in this embodiment, suction heads, with a suction cup connected to a suction system, of conventional type and not shown in the figures, which is actuated at the gripping spot G to capture a respective linear lid 2.

It is understood that said suction cup can also be operated with positive pressure to cause the immediate detachment of the respective linear lid 2.

It is further understood that the gripping head 14 may comprise a suction cup operating in a passive manner, or a type of pincer which is activated and deactivated by a respective actuating mechanism.

With reference to the figures, the rotary drum 10 of the transfer device 161 moves clockwise so that the moving transfer members 11 move towards the cutting device 162; in this configuration, called gripping configuration, the moving transfer members 11 are rotated so as to be perpendicular to the line tangent to the periphery of the transfer device 162 at the gripping spot G, i.e. at the spot directly facing the cutting device 162.

In this way, the gripping heads 14 protrude at the maximum distance from the periphery of the rotary drum 10 of the transfer device 161, and are thus in a position close to the cutting device 162.

By moving in the direction of the cutting device 162, the moving transfer members 11 are rotated counter-clockwise by a few degrees about their vertical axis Z, and, by moving closer, they are rotated clockwise, i.e. in accordance with the direction of rotation of the transfer device, to bring the gripping heads 14 closer to the cutting device.

By moving instead from the gripping spot G onwards, the moving transfer members are gradually rotated a few degrees clockwise, in a configuration of the moving transfer member 11 called transport, in which each gripping head 14 receives a laminar lid 2.

This rotation of the moving transfer members 11 can be achieved in many ways, for example by an electric motor adjusting the position of each body 12 by realising a so-called electronic cam.

Otherwise, it is possible to realise such a mechanism with only mechanical parts. For example, the rotary actuator comprises, for each moving transfer member 11, a cam follower which is therefore driven by the rotary drum 10, but interacts with a cam, integral to the fixed parts of the packaging apparatus 200, by moving thereon.

The shape of the cam is such that it causes the above-described rotation at least at the gripping spot G.

In general, therefore, the rotation of the rotating articulation transfer members is governed by a cam, which may be of a mechanical type, integral to the fixed frame, or of an electronic type; in the mechanical case it may also be realised by a set of cams. In this way the rotation of the moving transfer members 11 is synchronised with the rotation of the transfer device 161.

From the gripping spot G onwards, the transport path of the moving transfer members 11 comprises a transfer segment T (FIG. 2), where the moving transfer members 11 are in transport configuration.

The transfer segment T terminates at a first release spot R1, wherein the laminar lids 2 are transferred to the wheel of the sealing device 159, which rotates counter-clockwise about a vertical axis B, and receives the capsules 1 to be sealed from said fourth transfer wheel which rotates, adjacent to the sealing device, clockwise about a vertical axis C, so as to determine, at the sealing device, a second release spot R2.

At the first release spot R1, the laminar lids 11 are transferred to respective members of the sealing device 159 which receive them two by two, as well as receiving pairs of capsules 11 from the fourth transfer wheel 158.

The cutting device 162 comprises a casing 20 on which a cutting face 21 is defined, on which a pair of punches 22 acts.

In front of the cutting face 21, said strip 3 is retained in a predetermined position, which is kept in tension by a pair of tensioning rollers 23 which are located one on one side and the other on the opposite side of the cutting face 21.

The position of the tensioning rollers 23 is such that the strip 3 lies on a cutting plane which is vertical to the ground, perpendicular to the plane on which the transport path of the transfer device lies and parallel to its axis of rotation A.

The two punches 22 are connected to respective drive stems 24 and have, at the cutting face 21, respective blades 25 forming a circular cutting contour.

The drive stems 24 are connected to respective cutting actuators 30, which act on their proximal ends by means of a kinematic chain that allows the reciprocating motion of the stems 24.

The two punches 22 are arranged in a column, i.e. arranged one above the other vertically, at a distance which is equal to the distance separating two gripping heads 14 of a moving member 11.

Thus, at the gripping spot G, the two gripping heads 14 are in a position that corresponds, in the gripping configuration of the moving transfer member 11, to the same number of many punches 22 arranged in a column in the cutting device 162.

In this way, the laminar lids 2 are transported by their respective gripping heads 14 in a flow, formed on the transfer device 161, which is formed by two lines of laminar lids 2, and furthermore these two lines are superimposed, i.e. each laminar lid 2 of one line corresponds to a laminar lid (2) of the other line arranged on its vertical.

The two lines both lie on the same cylindrical surface with a vertical axis defined by the gripping heads 14. Thus, from the gripping spot G and along the transfer segment, the laminar lids lie on a respective plane that is arranged in a vertical position, and they travel through a revolution and simultaneous rotation, always exposing their faces to the outside of the transfer device 161.

This facilitates the transfer of the laminar lids 2 to the sealing device 159 at the first release spot R1 two by two.

The cutting device 162 comprises, at the cutting face 21, an inlet slot 26 through which said strip 3 is introduced, which comes out, after its punching, from an outlet slot.

The inlet and outlet slots obtained in the cutting face 21 of the cutting device 162, together with the tensioning rollers 23 constitute a tensioning and transport mechanism of the strip 3, and create a cutting segment in which the strip 3 is tensioned on its own cutting plane, on which the blades 25 of the punches 22 act.

The tensioning and transport mechanism comprises a first fixed contrast element 27, arranged on the outside of the cutting face 21 so as to form one side of said inlet slots 26 and outlet slots, and a second contrast element 28.

The second contrast element 28 is connected to a contrast stem 29 inserted between said drive rods 24, and connected, through a respective kinematic chain, to a corresponding contrast actuator 31.

Figure 7C:
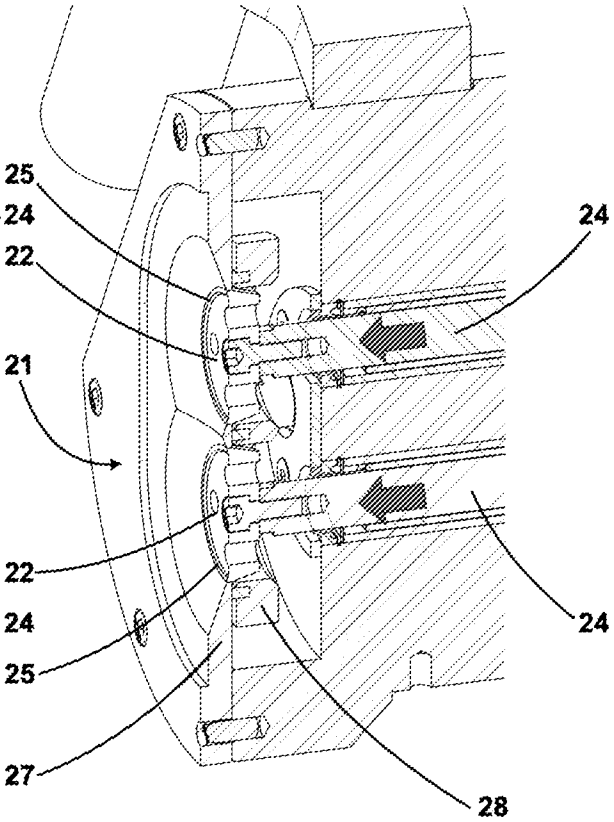
FIGS. 7A to 7C show respective perspective views of a cutting device in longitudinal section, illustrating various steps of the lid cutting in the packaging apparatus of FIG. 3.

Therefore, the second contrast element 28 is movable by a first cutting configuration (FIGS. 7B and 7C), in which it is pressed on the first contrast element 27 so as to block the strip 3 in its cutting position, and a second sliding configuration (FIG. 7A), in which the second contrast element 28 is moved away from said first contrast element 27.

In addition, the punches 22 are also movable from a cutting configuration (FIG. 7C), in which they are advanced towards the cutting face 21, with the blades 25 penetrating the strip 3, and a sliding configuration (FIGS. 7A and 7B), in which the punches 22 and the blades 25 are retracted with respect to the strip 3.

When both the second contrast element 28 and the punches 22 are in a sliding configuration (FIG. 7A), the strip 3 is slid into the inlet slots 26 and outlet slots by means of a driving action imparted by the tensioning rollers 23.

When both the second contrast element 28 and the punches 22 are in the cutting configuration (FIG. 7C), the strip 3 is cut, the laminar lids 2 are formed and are removed from their respective gripping heads 14.

Figure 7B:
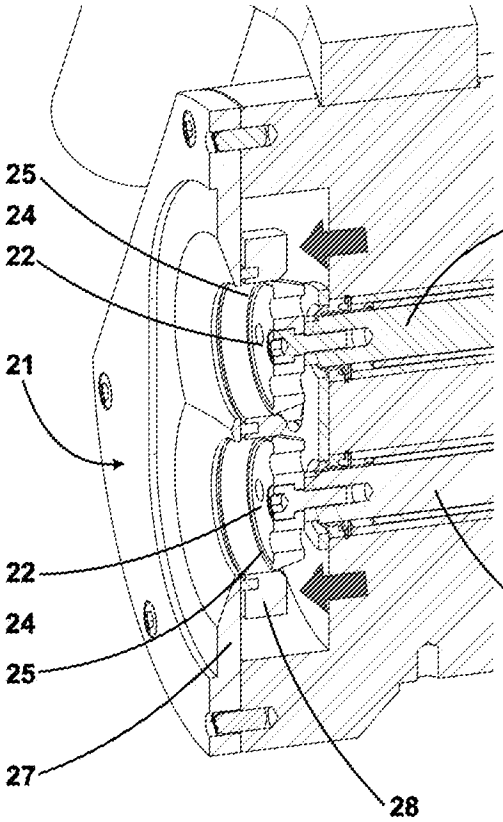
Figure 7A:
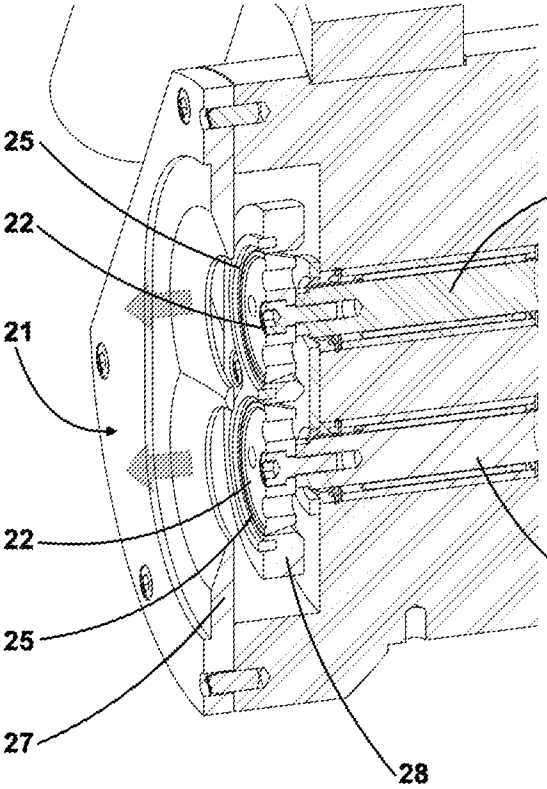

In the intermediate position, with the punches 22 in the sliding configuration and the second contrast element 28 in the cutting configuration, the strip 3 is tensioned and blocked, ready to be cut (FIG. 7B).

It should be noted that, due to the position of the tensioning rollers 23 and the inlet slots 26 and outlet slots, the strip 3, at said cutting plane, is arranged so as to be tilted by about 45° with respect to the plane on which said closed path lies.

In this way, punches 22, which are positioned vertically, cut the laminar lids two in two lines, but these are arranged staggered to each other with respect to the linear development of the strip 3.

In this way, the waste of the strip 3 is reduced to a minimum, as the laminar lids are made from as little space as possible on the strip 3.

It is understood that the packaging apparatus described herein can be used in any production apparatus, including for non-infusion type capsules, i.e. in all cases where a laminar lid is cut and applied to the opening of a capsule of any form and function.

The laminar lids 2 described herein have a disc shape, but it is understood that this invention can be adapted to lids of any shape.

To the above-described packaging apparatus for infusion type capsules, a person skilled in the art may, to meet additional and contingent requirements, make numerous further modifications and variations, all of which are, however, within the scope of protection of the present invention as defined by the appended claims.

The invention claimed is:

1. A packaging apparatus for capsules, the capsules comprising a container having an opening configured to be closed by a laminar lid applied to the opening, the laminar lid being formed by cutting a strip, said packaging apparatus comprising:

a cutting device, comprising: i) a tensioning and transport mechanism for a strip, defining a portion of the strip where the strip is tensioned in a respective cutting plane arranged in a vertical position, and ii) one or more punches to cut laminar lids from said strip; and a carousel-like transfer device having movable transfer members, each having at least one gripping head configured to receive one respective laminar lid directly from the strip from the cutting device, the movable transfer members configured to move along a closed path, wherein a mutual position of the cutting device and the transfer device defines a gripping spot of said closed path, wherein the laminar lids are retained directly from the strip in said movable transfer members on a respective plane in a vertical position.

2. The packaging apparatus according to claim 1, wherein the closed path of the movable transfer members comprises a transfer segment extending from said gripping spot to a subsequent release spot of the laminar lid.

3. The packaging apparatus according to claim 2, wherein each movable transfer member is configured to move between a transport configuration and a gripping configuration, and said at least one gripping head is moved towards the strip at said gripping spot, said transport configuration being in said transfer segment of the closed path.

4. The packaging apparatus according to claim 3, wherein the laminar lids are retained by respective gripping heads in a vertical position along an entirety of the transfer segment.

5. The packaging apparatus according to claim 1, wherein each movable transfer member comprises two or more gripping heads vertically arranged in columns at the movable transfer member, said two or more gripping heads being in an arrangement corresponding, in said gripping configuration, to a same number of punches arranged in a column in the cutting device.

6. The packaging apparatus according to claim 1, wherein, at said cutting plane, the strip is arranged to be tilted with respect to a plane on which said closed path lies, wherein the laminar lids are cut, in said planar strip, along a plurality of lines with the laminar lids staggered to each other.

7. The packaging apparatus according to claim 1, wherein each movable transfer member is further arranged to rotate about an axis perpendicular to the plane on which said closed path lies, from a transport configuration to a gripping configuration and vice versa.

8. The packaging apparatus according to claim 1, wherein each gripping head is a suction head.

9. The packaging apparatus according to claim 1, wherein the transfer device is further configured to rotate about a vertical axis, the movable transfer members being arranged in a circular closed path lying on a horizontal plane formed on a periphery of the transfer device.

10. An apparatus for manufacturing infusion type capsules, comprising the packaging apparatus according to claim 1.

11. A packaging process for capsules comprising a container having an opening configured to be closed by a laminar lid applied to the opening, comprising:

a cutting step, wherein a strip is transported in a tensioned state on a cutting plane in a vertical position, and wherein one or more punches cut corresponding laminar lids from said strip; and a gripping step of gripping the laminar lids wherein, once cut by said punches, the laminar lids are gripped directly from the strip at a gripping spot by respective gripping heads moving along a closed path, wherein the cutting step and the gripping step are performed in the gripping spot, and the laminar lids at said gripping spot are retained in a respective plane in a vertical position.

12. The packaging process according to claim 11, wherein said laminar lids are retained by said respective gripping heads in a vertical position in a transfer segment extending from said gripping spot to a subsequent release spot.

13. The packaging process according to claim 11, wherein said laminar lids are transported by said respective gripping heads in a flow formed by two superimposed lines of laminar lids.

* * * * *